United States Patent [19]

Burke

[11] Patent Number: 4,593,900

[45] Date of Patent: Jun. 10, 1986

[54] BOXING ROBOT

[76] Inventor: Thomas J. Burke, 261 Medina Drive, Keswick, Ontario, Canada, L4P 1H3

[21] Appl. No.: 702,129

[22] Filed: Feb. 15, 1985

[30] Foreign Application Priority Data

Feb. 16, 1984 [CA] Canada ..... 447619

[51] Int. Cl.[4] ..... A63B 69/00

[52] U.S. Cl. ..... 272/76

[58] Field of Search ..... 272/76–78; 901/14, 50; 446/376, 381, 383, 334, 390; 273/55 R, 55 B, 1.5 A; 434/251, 252, 256, 257

[56] References Cited

U.S. PATENT DOCUMENTS

| | | | |
|---|---|---|---|
| 835,796 | 11/1906 | Lindsley | 272/76 |
| 2,909,370 | 10/1959 | Fortney | 272/76 |
| 3,415,523 | 12/1968 | Boldt | 434/252 X |
| 3,552,749 | 1/1971 | Piggotte | 273/55 X |
| 3,804,406 | 4/1974 | Viscione | 272/76 |
| 4,307,891 | 12/1981 | Doornick et al. | 901/14 X |

FOREIGN PATENT DOCUMENTS

| | | | |
|---|---|---|---|
| 0705216 | 3/1941 | Fed. Rep. of Germany | 272/78 |
| 0602200 | 4/1978 | U.S.S.R. | 272/76 |

*Primary Examiner*—Richard J. Apley
*Assistant Examiner*—Kathleen D'Arrigo
*Attorney, Agent, or Firm*—James T. Wilbur

[57] ABSTRACT

The robot is composed of a figure simulating a boxer which is mounted to a post. A first arm is mounted to the post for pivoting in a vertical plane. A second arm is mounted to a vertical rod mounted within the figure. A prime mover causes the rod to rotate and as it does so, the second arm rotates in a horizontal plane. A roller is connected to the rod and periodically contacts the second arm thereby causing the arm to elevate. Gravity causes the second arm to fall when it is not contacted by the roller. The roller is so positioned to the rod that it causes the second arm to elevate when the first arm is behind the figure and allows the second arm to fall when the first arm is in front of the figure.

5 Claims, 2 Drawing Figures

BOXING ROBOT

CROSS-REFERENCE TO PRIOR ART

U.S. Pat. No. 1,559,419 EXERCISING APPARATUS M. Golomb, issued Oct. 27, 1925.

U.S. Pat. No. 419,285 EXERCISING APPARATUS G. S. Sanborn, issued Jan. 14, 1890.

U.S. Pat. No. 1,716,678 EXERCISING DEVICE G. Attanasio, issued June 11, 1929.

U.S. Pat. No. 3,250,533 SPARRING DEVICE J. P. Nicholson, issued May 10, 1966.

U.S. Pat. No. 2,909,370 BOXING DUMMY E. L. Fortney, issued Oct. 20, 1959.

U.S. Pat. No. 4,088,315 DEVICE FOR SELF-DEFENSE TRANINIG Rob't A. Schemmel, issued May 9, 1978. U.S. Pat. No. 3,804,406 KARATE FIGHTER Eugene G. Viscione, issued Apr. 16, 1974.

U.S. Pat. No. 3,387,842 SELF-DEFENSE MANIKIN PRACTICE DEVICE L. D. Edgar, issued June 11, 1968.

Russian Pat. No. 563,984.

BACKGROUND OF THE INVENTION

This invention relates to a boxing robot and more particularly to a robot having arms which move in a manner adapted to ward off blows directed at its head.

Robots having moving parts which simulate the movement of a boxer have been known for many years. Some robots move in response to blows directed against them, others move independently of such blows and in a way that forces the boxer who is using them to move quickly to avoid being struck by the robot's fists or arms.

Boxing robots simulate the movement of a boxer but move in a predetermined predictable way. A boxer who is using them can, without difficulty, hit the robots consistently. In order to withstand repeated blows, the robots must be ruggedly constructed but must not be so ruggedly constructed that they injure a boxer who is struck by them.

Known boxing robots which satisfy the requirements of rugged construction and safe operation tend to suffer from one or more shortcomings. Some are complicated of construction and difficult to repair. Others, while relatively simple of construction, move slowly and predictably so that a boxer has ample time to move out of their way to avoid being injured by the devices. Such robots pose little challenge to a boxer.

SUMMARY OF THE INVENTION

It is an object of this invention to provide a boxing robot which is both rugged and simple of construction and repair.

It is another object to provice a robot which challenges a boxer by its movement but which does no injury should it strike him.

It is a still further object to provide a robot having arms which operate successively to protect the robot's head. The interval of time during which the head is unprotected by either arm is very limited and accordingly the boxer must strike quickly to hit the head and must also withdraw quickly to avoid being hit by the arms.

These and other objects of the invention are accomplished by a robot for a boxer comprising; a figure simulating a boxer; an upper arm mounted to the figure for horizontal rotation; a lower arm mounted for vertical reciprocation from a lower to an upper position; and means for coordinating the movement of the upper arm relative to the lower arm such that the upper arm is in front of the figure at the same time as the lower arm is the the lower position and the upper arm is behind the figure at the same time as the lower arm is the the upper position.

DESCRIPTION OF THE DRAWING

The invention is described in detail with reference to the accompanying drawing in which.

Like reference characters refer to like parts throughout the description of the drawing.

DESCRIPTION OF THE PREFERRED EMBODIMENT

Figure 1:
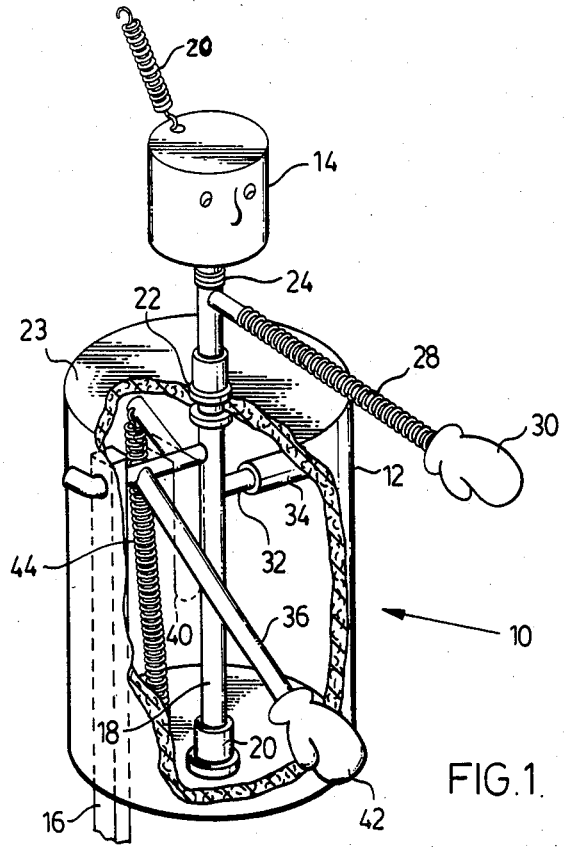
FIG. 1 is a perspective view, partly cut away, of the robot of the invention.

With reference to the drawing, the robot of the invention, generally 10, is in the form of a human figure having a body 12 and a head 14. The body is in the form of a hollow cylinder and is attached to and is supported by a column or post 16 which rests on a pedestal (not illustrated).

A rod 18 is disposed co-axially within the body and is mounted in bearings in the lower and upper walls 20, 22 respectively of the body. The rod is rotated by a prime mover (not illustrated) preferably mounted within the body. The rod extends upwardly through an aperture in the upper wall 22 of the body and terminates at a rotatable joint 24 to which head 14 is attached.

Joint 24 supports the head and makes it possible to prevent the head from being rotated by the rod. To this end, a coil spring 26 is connected to the head and to some suitable stationary object (not illustrated) such as the ceiling or wall of the room in which the robot is standing.

Connected to the rod adjacent to the rotatable joint is an upper horizontal arm 28. The arm is in the form of an elongated coil spring which is sufficiently strong that it remains straight when it is not in contact with an obstruction but which flexes when it strikes an obstruction such as the body of a person who is using the robot. By means of the spring, the upper arm may continue to rotate despite the fact that it has struck an obstruction.

The upper arm extends radially outwardly of the rod and a boxing glove 30 is disposed at its outer free end. The glove is maintained in a suitable shape by means such as a rubber ball located inside the glove.

A bar 32 is fixed to the portion of the rod within the body and extends radially from the rod. The angle between the bar and the downward vertical projection of the upper arm 28 is approximately 90 degrees.

A roller 34 is disposed co-axially about the bar and is mounted on bearings for rotation thereabout. The roller rotates into contact with the lower wall of a lower arm 36 during each cycle of the rod.

Arm 36 is pivotally mounted to the upper end of post 16 and extends through a slot 40 in the side wall of the body. The arm terminates at a second boxing glove 42. The end of the lower arm opposite the glove is connected to resilient means in the form of a coil spring 44. The coil spring is also connected to the post.

Figure 2:
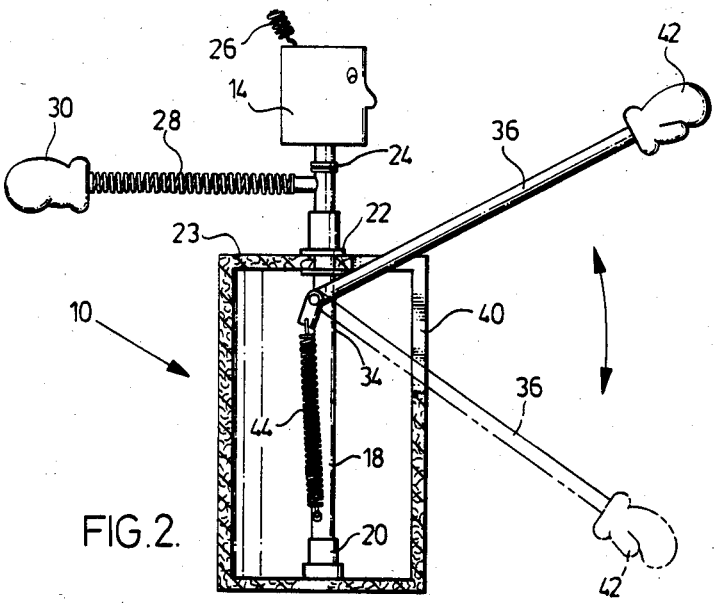
FIG. 2 is an elevation, partly in section, of the robot.

The operation of the lower and upper arms is illustrated in FIG. 2. As roller 34 rotates to the position illustrated in that figure, the roller causes the lower arm 36 to rise to the position illustrated in solid lines. At that time the upper arm 28 is directly behind the figure. As the roller continues to rotate away from the lower arm, the arm will fall to the position illustrated in broken lines in that figure. At that time the upper arm 28 will be immediately in front of the figure.

Gravity causes the lower arm 36 to descend immediately after the roller has rotated away from contact with the arm. As the arm descends, spring 44 lengthens against its bias and accordingly retards the rate of descent of the lower arm. The spring accordingly makes the movement of the lower arm less rapid or jerky with resulting lessening in the wear on the bearings in which the arm is mounted. The spring also serves to shorten the period during which the head is unprotected by the lower arm.

The head of the robot will be protected successively by the upper arm and by the lower arm during each rotation of the roller. The shorter the interval of time of each cycle, the shorter the time that the head is unprotected by either arm.

It will be understood of course that modifications can be made in the preferred embodiment described herein without departing from the scope and purview of the invention as defined in the appended claims.

What is claimed is:

1. A robot for a boxer comprising: a figure simulating a boxer; an upper arm mounted to said figure for horizontal rotation; a lower arm mounted for vertical reciprocation from a lower to an upper position; and means for coordinating the movement of said upper arm relative to said lower arm such that said upper arm is in front of said figure at the same time as said lower arm is at said lower position and said upper arm is behind said figure at the same time as said lower arm is at said upper position.

2. A robot for a boxer comprising: a figure simulating a boxer and having upper and lower arms, said lower arm being mounted for vertical pivoting; a rod which is rotatably mounted within said body and to which said upper arm is mounted, a bar connected to said rod and about which a roller is rotatably mounted, said roller, as said rod rotates, alternatively contacting said lower arm with resulting elevation thereof to an upper position and withdrawing from contact thereof at which time said lower arm descends to a lower position.

3. The robot as claimed in claim 1 or 2 wherein said upper arm is in the form of an elongated spring which flexes when it contacts an obstruction.

4. The robot as claimed in claim 1 or 2 further including resilient means which interconnect said lower arm and said body, the bias of said resilient means opposing downward movement of said lower arm and thereby retarding the rate of such movement.

5. The robot as claimed in claim 1 or 2 further including a rotatable joint which interconnects said head and said rod, and a spring connected to said head and adapted to be connected to a stationary object for preventing said head from turning.

* * * * *